US005201522A

United States Patent [19]

Pocklington et al.

[11] Patent Number: 5,201,522

[45] Date of Patent: Apr. 13, 1993

[54] GOLF BALL

[75] Inventors: Terence W. Pocklington, Tupelo; William L. Crausby, Pontotoc, both of Miss.

[73] Assignee: Ram Golf Corporation, Melrose Park, Ill.

[21] Appl. No.: 795,918

[22] Filed: Nov. 20, 1991

[51] Int. Cl.[5] ..... A63B 37/14

[52] U.S. Cl. ..... 273/232

[58] Field of Search ..... 273/232

[56] References Cited

U.S. PATENT DOCUMENTS

| | | | |
|---|---|---|---|
| 4,729,861 | 3/1988 | Lynch et al. | 273/232 X |
| 4,932,664 | 6/1990 | Pocklington et al. | 273/232 |
| 4,960,281 | 10/1990 | Aoyama | 273/232 |
| 4,960,282 | 10/1990 | Shaw | 273/232 |
| 5,009,427 | 4/1991 | Stiefel et al. | 273/232 |

FOREIGN PATENT DOCUMENTS

| | | | |
|---|---|---|---|
| 0217483 | 4/1987 | European Pat. Off. | 273/232 |
| 0234081 | 4/1987 | European Pat. Off. | 273/232 |
| 377354 | 8/1932 | United Kingdom | 273/232 |

*Primary Examiner*—George J. Marlo

*Attorney, Agent, or Firm*—James P. Ryther

[57] ABSTRACT

A golf ball construction wherein the dimples are distributed over the surfaces of the ball to minimize the appearance and effect of an unbroken seam line and to enhance the aerodynamic properties of the ball. The arrangement of the dimples includes a pole dimple at each pole, a pentagon formation of dimples in each hemisphere of the ball comprising five equally-spaced lines of dimples radiating outwardly from the pole dimple to thereby define five triangular areas of dimples in the pentagon formation, the bases of the triangular areas comprising five interconnected lines of dimples equally spaced from the pole dimple. Five equally spaced additional triangular areas are formed in each hemisphere, each having a base on the equator of the ball, and a plurality of additional dimples are then disposed in a non-uniform fashion about the remaining surface of the ball. The arrangement of the non-uniformly placed dimples favors the placement of the dimples closer to the equator of the ball. Each pentagon formation includes 51 dimples, each triangular area having a base adjacent the equator includes 10 dimples, and the entire ball surface has 442 dimples formed thereon.

5 Claims, 2 Drawing Sheets

GOLF BALL

BACKGROUND OF THE INVENTION

This invention relates to golf balls and in particular to golf balls having dimples formed on the surface. The golf balls are of conventional design in the sense that specifications of the United States Golf Association are complied with from the standpoint of parameters such as an outer diameter of a minimum of 1.680 inches. Similarly, conventional dimple depths of about 0.01 to about 0.015 inches are contemplated.

In the manufacture of golf balls of either a two-piece or three-piece variety, one method used is compression molding wherein two hemispherical cover shells are applied over a core and joined at the equatorial seam by heat and pressure. This results in a "seam line" free of any dimples which creates certain functional and aesthetic problems. As to function, non-uniformity of the dimple pattern yields less satisfactory results from the standpoint of consistency of performance.

From an aesthetic point of view, if the golf balls are randomly oriented for imprinting of trademarks and other information thereon, the seam line can create the optical illusion that the ball is not spherical, or can otherwise give the impression of an improperly produced ball. For this reason, it has been necessary to carefully orient some balls before imprinting in order to produce a ball with the best possible appearance.

One solution to the foregoing problem is disclosed in U.S. Pat. No. 4,932,664, issued Jun. 12, 1990 to Pocklington et al. and assigned to the common assignee, which patent is incorporated herein by reference in its entirety. In that patent, a golf ball is disclosed wherein the dimples are evenly distributed over the surface and are arranged in three different patterns comprising a pentagon formation at each of the poles, five equally-spaced trapezoid formations in each hemisphere, and five equally-spaced triangular formations in each hemisphere interposed between the trapezoid formations. This golf ball construction successfully minimizes the appearance and effect of an unbroken seam line. It would be desirable, however, to provide a golf ball construction with these same advantages, and also with even further improvements in aerodynamic properties while still complying with the aerodynamic symmetry requirements of the United States Golf Association, which state in part that the ball shall be designed to perform in general as if it were spherically symmetrical.

SUMMARY OF THE INVENTION

In accordance with this invention, a golf ball is produced with a pattern of dimples designed to minimize any appearance of an unbroken seam line. This enables the production of golf balls characterized by consistent performance and also suitable for random imprinting thereby minimizing the cost associated with that operation. In addition, the pattern of dimples is designed to enhance the aerodynamic symmetry of the golf ball for superior performance characteristics.

Considering the parting line between the hemispheres of the ball as the equator, the pattern of dimples includes a pentagon formation of a plurality of dimples at each of the poles. In each of the areas between these formations and the equator, there are five equally-spaced triangular formations of a plurality of dimples. Interposed between the triangular formations and the pentagon formations are a plurality of dimples disposed in a non-uniform fashion.

In the preferred form of the invention, each of the pentagon formations includes 51 dimples, each of the triangular formations includes 10 dimples, and each hemisphere includes additional 120 dimples disposed in a non-uniform fashion. This provides 221 dimples in each hemisphere for a total of 442 dimples on the surface of the ball.

The diameters of the dimples are preferably controlled to enhance the uniformity of appearance. Typically, the diameters of the dimples will depend on the number thereof; thus, where greater numbers of dimples are employed, the diameter will be smaller, and vice versa. The diameters are also dependent on the "spacing" between dimples which is defined as the distance between the closest points of the edges of adjacent dimples. Typically, dimple diameters will vary between about 0.0130 and about 0.175 inches, and the spacing between at or near touching to about 0.070 inches. In the preferred form of this invention, when 442 dimples are employed, the diameter of each of the dimples is about 0.145 inches. Dimple spacing will vary between about 0.070 inches to about 0.001 inches apart, that is, at or near touching.

To further enhance both the appearance of uniformity and the aerodynamic characteristics of the golf ball, the dimples are disposed within each hemisphere such that the bases of the triangular formations of each hemisphere are included in the line of dimples in that hemisphere adjacent the equator, and the bases of the triangular formations on opposite sides of the equator are disposed in an alternating relationship, such that none of the dimples forming a triangular base on one side of the equator are directly opposite any of the dimples forming a triangular base on the other side of the equator. In addition, the non-uniform arrangement of those dimples which are not in either the pentagonal or the triangular formations favors the placement of the dimples closer to the equator, such that the dimples at the equator are in more of a serpentine configuration. This feature balances the aerodynamics at the equator with the aerodynamics at the poles by increasing aerodynamic turbulence at the equator.

DESCRIPTION OF THE PREFERRED EMBODIMENT

Figure 1:
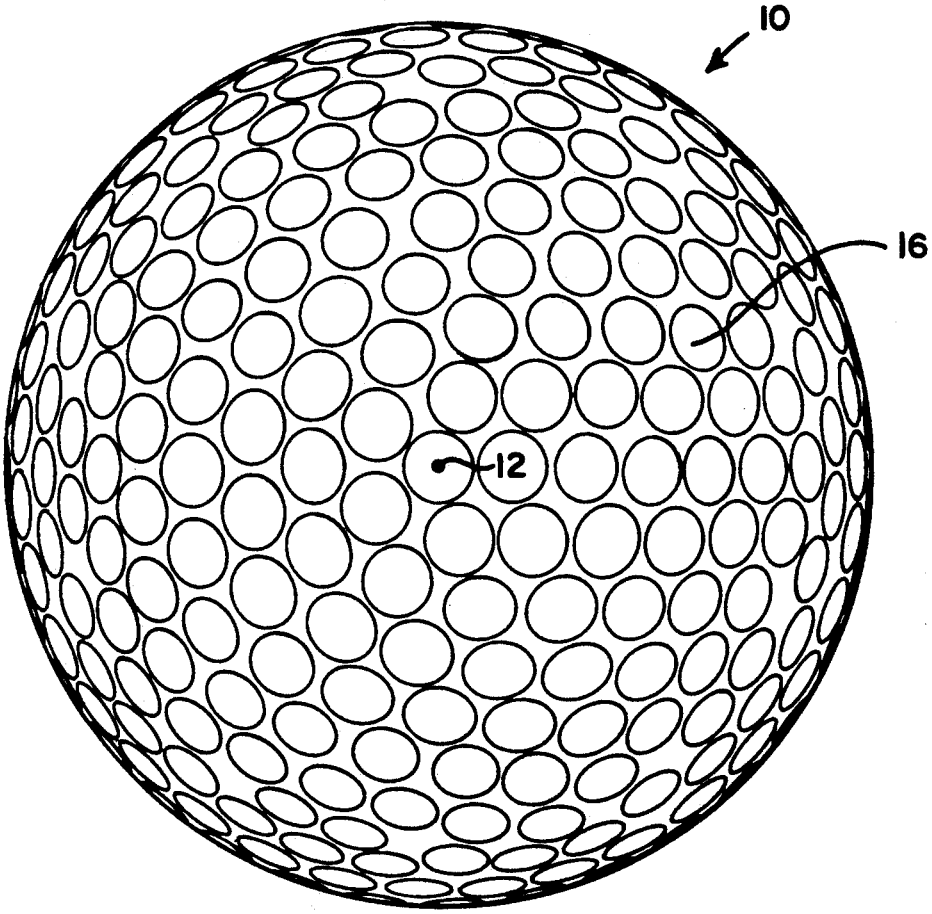
FIG. 1 illustrates a plan view of a golf ball produced in accordance with this invention.

The golf ball 10 shown in the drawings includes a pole position 12 and a seam line or equator 14. The surface of the ball includes dimples 16 formed in any conventional fashion.

Figure 2:
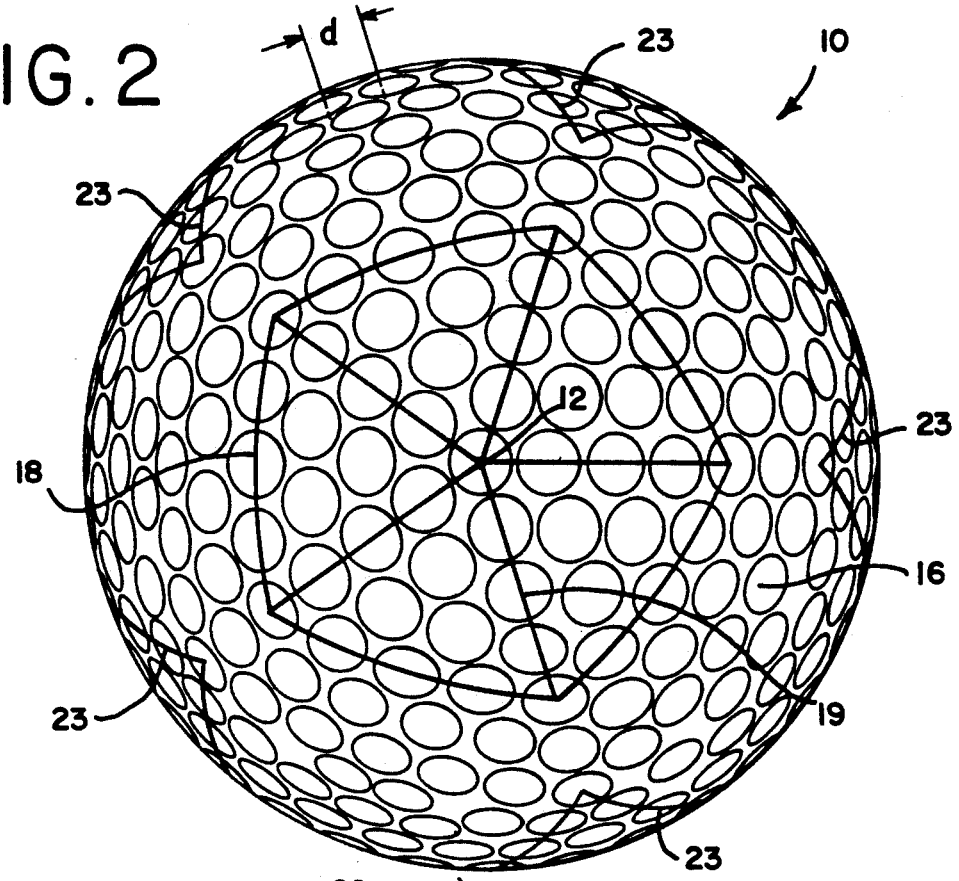
FIG. 2 comprises the same view of the golf ball of FIG. 1 while showing the patterns of different dimple formations.
Figure 3:
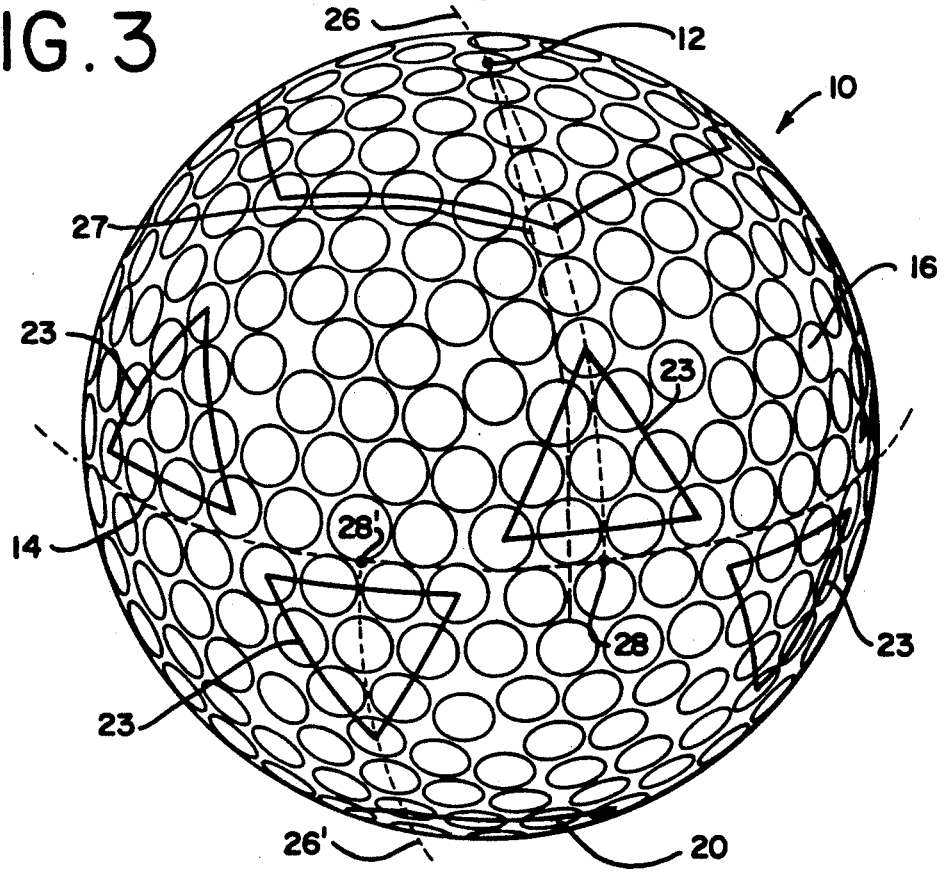
FIG. 3 is an approximate side elevation of the golf ball of FIG. 1 showing the patterns of the different dimple formations.

As best shown in FIGS. 2 and 3, the dimples are divided into different formations including a pentagon formation 18 having a center dimple at the pole 12 in the hemisphere shown in FIG. 2. A second identical pentagon formation 20 is formed around the pole of the other hemisphere. Each pentagon formation consists of five triangular areas 19, and 51 dimples make up each such pentagon formation.

Each triangular formation 23 comprises 10 dimples, including a base of four dimples. The bases of the triangles are included in the line of dimples adjacent the equator. The triangular formations on either side of the equator are arranged in an alternating manner with respect to one another, such that none of the dimples in the base of any triangle on one side of the equator is in direct facing relationship to any dimple in the base of a triangle on the opposite side of the equator. This enhances the uniformity of appearance.

The regions of the golf ball surface which are not covered by the pentagonal and triangular formations are covered by dimples disposed in a non-uniform fashion. The arrangement of these dimples favors the placement of the dimples closer to the equator of the ball to offset the undesirable uniformity that would otherwise be created at the equator. Furthermore, dimples on opposite sides of the equator are offset from one another to create a serpentine line of dimples about the equator. This offset relationship is illustrated by line 27 which extends from the center point of pole dimple 12 to the center point of a dimple on one side of the equator and then extends further between the center points of an adjacent pair of dimples on the opposite side of the equator. This creates aerodynamic turbulence to improve the golf ball lift and decrease the drag on the golf ball during flight.

In the preferred embodiment there are 120 dimples disposed in the non-uniform fashion in each hemisphere of the golf ball.

The preferred dimple diameter (FIG. 2) is about 0.145 inches. The spacing between the dimples can vary from about 0.070 inches at the greatest, to a substantially touching relationship.

Following is a chart identifying the dimple center point locations for each of the 442 dimples utilized in the golf ball comprising the preferred embodiment of the invention. In this chart, "VERT ANG" refers to the degrees and minutes above or below the seam line or equator 14 which is considered at 0°. "HOR ANG" refers to the degrees and minutes from the longitudinal lines 26 and 26' which are considered at 0° and which extend, in the respective hemispheres, between a pole and the equator. The intersections of these lines with the equator, at 28 and 28', are thus the 0° vertical and 0° horizontal position for the upper and lower hemispheres, respectively.

| | DIMPLE DIAMETER 0.145 | | | | | | | | | | |
|---|---|---|---|---|---|---|---|---|---|---|---|
| VERT. ANG. Od AT SEAM | | HOR. ANG. | | | | | | | | | |
| 4d | 51 | 4d | 55 | 14d | 46 | 26d | 9 | 36d | 0 | 45d | 51 |
| | | 57d | 14 | 67d | 5 | 76d | 55 | 86d | 46 | 98d | 9 |
| | | 108d | 0 | 117d | 51 | 129d | 14 | 139d | 5 | 148d | 55 |
| | | 158d | 46 | 170d | 9 | 180d | 0 | 189d | 51 | 201d | 14 |
| | | 211d | 5 | 220d | 55 | 230d | 46 | 242d | 9 | 252d | 0 |
| | | 261d | 51 | 273d | 14 | 283d | 5 | 292d | 55 | 302d | 46 |
| | | 314d | 9 | 324d | 0 | 333d | 51 | 345d | 14 | 355d | 5 |
| 13d | 0 | 20d | 25 | 51d | 35 | 92d | 25 | 123d | 35 | 164d | 25 |
| | | 195d | 35 | 236d | 25 | 267d | 35 | 308d | 25 | 339d | 35 |
| 13d | 25 | 0d | 0 | 72d | 0 | 144d | 0 | 216d | 0 | 288d | 0 |
| 13d | 30 | 30d | 54 | 41d | 6 | 102d | 54 | 113d | 6 | 174d | 54 |
| | | 185d | 6 | 246d | 54 | 257d | 6 | 318d | 54 | 329d | 6 |
| 13d | 36 | 10d | 6 | 61d | 54 | 82d | 6 | 133d | 54 | 154d | 6 |
| | | 205d | 54 | 226d | 6 | 277d | 54 | 298d | 6 | 349d | 54 |
| 21d | 45 | 25d | 15 | 46d | 45 | 97d | 15 | 118d | 45 | 169d | 15 |
| | | 190d | 45 | 241d | 15 | 262d | 45 | 313d | 15 | 334d | 45 |

-continued

| | DIMPLE DIAMETER 0.145 | | | | | | | | | | |
|---|---|---|---|---|---|---|---|---|---|---|---|
| VERT. ANG. Od AT SEAM | | HOR. ANG. | | | | | | | | | |
| 22d | 10 | 36d | 0 | 108d | 0 | 180d | 0 | 252d | 0 | 324d | 0 |
| 22d | 20 | 5d | 20 | 66d | 40 | 77d | 20 | 138d | 40 | 149d | 20 |
| | | 210d | 40 | 221d | 20 | 282d | 40 | 293d | 20 | 354d | 40 |
| 25d | 54 | 15d | 24 | 56d | 36 | 87d | 24 | 128d | 36 | 159d | 24 |
| | | 200d | 36 | 231d | 24 | 272d | 36 | 303d | 24 | 344d | 36 |
| 30d | 35 | 30d | 10 | 41d | 50 | 102d | 10 | 113d | 50 | 174d | 10 |
| | | 185d | 50 | 246d | 10 | 257d | 50 | 318d | 10 | 329d | 50 |
| 31d | 0 | 0d | 0 | 72d | 0 | 144d | 0 | 216d | 0 | 288d | 0 |
| 35d | 0 | 10d | 45 | 61d | 15 | 82d | 45 | 133d | 15 | 154d | 45 |
| | | 205d | 15 | 226d | 45 | 277d | 15 | 298d | 45 | 349d | 15 |
| 38d | 5 | 22d | 24 | 49d | 36 | 94d | 24 | 121d | 36 | 166d | 24 |
| | | 193d | 36 | 238d | 24 | 265d | 36 | 310d | 24 | 337d | 36 |
| 39d | 15 | 36d | 0 | 108d | 0 | 180d | 0 | 252d | 0 | 324d | 0 |
| 40d | 49 | 0d | 0 | 72d | 0 | 144d | 0 | 216d | 0 | 288d | 0 |
| 44d | 45 | 12d | 40 | 59d | 20 | 84d | 40 | 131d | 20 | 156d | 40 |
| | | 203d | 20 | 228d | 40 | 275d | 20 | 300d | 40 | 347d | 20 |
| 47d | 10 | 27d | 45 | 44d | 15 | 99d | 45 | 116d | 15 | 171d | 45 |
| | | 188d | 15 | 243d | 45 | 260d | 15 | 315d | 45 | 332d | 15 |
| 50d | 44 | 0d | 0 | 72d | 0 | 144d | 0 | 216d | 0 | 288d | 0 |
| 54d | 30 | 16d | 30 | 56d | 30 | 88d | 30 | 127d | 30 | 160d | 30 |
| | | 199d | 30 | 232d | 30 | 271d | 30 | 304d | 30 | 343d | 30 |
| 56d | 0 | 36d | 0 | 108d | 0 | 180d | 0 | 252d | 0 | 324d | 0 |
| 60d | 33 | 0d | 0 | 72d | 0 | 144d | 0 | 216d | 0 | 288d | 0 |
| 64d | 15 | 22d | 36 | 49d | 24 | 94d | 36 | 121d | 24 | 166d | 36 |
| | | 193d | 24 | 238d | 36 | 265d | 24 | 310d | 36 | 337d | 24 |
| 70d | 22 | 0d | 0 | 72d | 0 | 144d | 0 | 216d | 0 | 288d | 0 |
| 73d | 30 | 36d | 0 | 108d | 0 | 180d | 0 | 252d | 0 | 324d | 0 |
| 80d | 11 | 0d | 0 | 72d | 0 | 144d | 0 | 216d | 0 | 288d | 0 |
| 90d | 0 | 0d | 0 | | | | | | | | |

To further illustrate the chart content, it will be noted that 35 of the dimple center points adjacent the equator are located 4 degrees, 51 minutes either above or below the equator. The first dimple of the 35 in the upper hemisphere to the right of line 26 has a center point 4 degrees, 55 minutes from this line, and the next dimple point is 14 degrees, 46 minutes from this line. Each successive dimple position is shown up to the 35th dimple which is located 355 degrees, 5 minutes from the longitudinal line 26. This dimple is, of course, adjacent the first dimple.

The same relationship prevails in the lower hemisphere with the longitudinal line 26' extending from the zero degree reference point 28'. Thus, the first of the 35 dimples adjacent the equator will have its center point 4 degrees, 51 minutes below the equator 14, and 4 degrees, 55 minutes horizontally from the point 28'.

The chart also illustrates the positions of each of the remaining dimples. Thus, the 35 dimples immediately above and below the dimples adjacent the equator have center points varying between 13 degrees, 0 minutes and 13 degrees, 36 minutes above and below the equator. The first dimple in this group (at a vertical angle of 13 degrees, 25 minutes) is centered on the line 26. The first dimple to the right of longitudinal line 26 (at a vertical angle of 13 degrees, 36 minutes) has a center point 10 degrees, 6 minutes from that line. The last dimple in this group (also at a vertical angle of 13 degrees, 36 minutes) has a center point 349 degrees, 54 minutes from the line 26.

The angles for the vertical locations shown progress to the 90 degrees, 0 minutes pole location where the single dimple 12 is located.

The enhanced aerodynamic symmetry of the golf balls of the instant invention is illustrated by their performance in the U.S.G.A. Symmetry Test. In this test, 48 balls of identical dimple configurations are divided into two groups. The 24 balls in the first group are launched under prescribed standard conditions with the seam line (equator) oriented horizontally. The 24 balls in the second group are launched under identical conditions except that the seam line (equator) is oriented vertically. In order to pass the Symmetry Test, the average flight distance of the balls in the first and second groups must differ by no more than 3.0 yards, and the average flight time of the balls in the first and second groups must differ by no more than 0.3 seconds.

When 48 golf balls of the instant invention were tested in accordance with the instant invention, the balls in the first group had an average flight distance of 255.7 yards, while the balls in the second group had an average flight distance of 255.4 yards. The difference between these averages is 0.3 yards, which is well within the USGA specification of 3.0 yards. The balls in the first group had an average flight time of 6.23 seconds, while the balls in the second group had an average flight time of 6.18 seconds. The difference between these averages is 0.05 seconds, which is much less than the USGA specification of 0.3 seconds. These results show the superior aerodynamic symmetry of the golf balls of the instant invention.

It will be understood that various changes and modifications may be made in the above-described invention without departing from the spirit of the invention particularly as set forth in the following claims.

We claim:

1. In a golf ball construction wherein dimples are formed on a spherical surface, said surface defining opposite poles and an equator midway between said poles dividing said surface into two hemispheres, the improvement in the pattern of dimples formed on said surface, said pattern including:

(a) a pole dimple located at each pole;

(b) a pentagon formation of dimples in each hemisphere comprising five equally-spaced lines of dimples radiating outwardly from said pole dimple to thereby define five triangular area of dimples in said pentagon formation, the bases of said triangular areas comprising five interconnected lines of dimples equally spaced from said pole dimple, said interconnected lines defining a pentagon shape, and additional dimples located between said lines;

(c) five equally-spaced additional triangular areas of dimples in each hemisphere of dimples, the bases of said additional triangular areas in each hemisphere being included in a line of dimples in that hemisphere adjacent the equator with the bases of the additional triangular areas on opposite sides of the equator being disposed in an alternating relationship;

(d) a plurality of dimples disposed in a non-uniform fashion about the remaining surface of said golf ball outside of said pentagon and triangular formations to enhance the aerodynamic symmetry of said golf ball surface; and (e) each of said pentagon formations including 51 dimples, each of said additional triangular areas including 10 dimples, and said entire golf ball surface having 442 dimples formed thereon.

2. A golf ball according to claim 1 wherein all of said dimples are of substantially equal diameter.

3. A golf ball according to claim 2 wherein the diameter of each of said dimples is 0.145 inches.

4. A golf ball according to claim 3 wherein 221 dimples are located in each hemisphere.

5. A golf ball according to claim 1 wherein each line extending from the center point of a pole dimple to the center point of each dimple located on one side of the equator extends between the center points of an adjacent pair of dimples positioned on the opposite side of the equator.

* * * * *